United States Patent [19]

Shwayder

[11] 4,450,601

[45] May 29, 1984

[54] SWEEPER DRAG SHOE

[76] Inventor: Warren M. Shwayder, 2335 E. Lincoln, Birmingham, Mich. 48008

[21] Appl. No.: 430,930

[22] Filed: Sep. 30, 1982

[51] Int. Cl.[3] ..... E01H 1/04

[52] U.S. Cl. ..... 15/246; 15/83; 75/236; 428/558

[58] Field of Search ..... 15/246, 82–87, 15/340; 428/551, 553, 558; 75/236–242

[56] References Cited

U.S. PATENT DOCUMENTS

| | | | |
|---|---|---|---|
| 3,916,497 | 11/1975 | Doi et al. | 75/236 |
| 3,997,934 | 12/1976 | Toews | 15/246 |
| 4,128,132 | 12/1978 | Moen et al. | 428/558 X |

*Primary Examiner*—Timothy F. Simone

*Attorney, Agent, or Firm*—Cullen, Sloman, Cantor, Grauer, Scott and Rutherford

[57] ABSTRACT

A sweeper drag shoe is formed of an elongated, flat, inverted channel filled with a matrix made of irregular shaped, packed together, hard carbide particles and soft, ductile relatively resilient brazing metal filling the spaces between and generally surrounding and brazing together the particles. The exposed matrix provides a ground engaging face which resists wear due to abrasion. The brittle carbide particles are protected against road shock caused breakage by means of the ductile brazing material absorbing impact loads and permitting limited relative movement of the particles within the solid matrix.

7 Claims, 8 Drawing Figures

SWEEPER DRAG SHOE

BACKGROUND OF THE INVENTION

This invention relates to an improvement to drag shoes that are used with horizontally axised, rotary brush street sweepers. A typical rotary brush street sweeper includes a self-propelled vehicle which carriers a large, horizontally arranged, rotary brush. Rotation of the brush causes its bristles to produce a sweeping action against the ground for sweeping debris, dirt, etc.

When the typical horizontally axised rotary brush is rotated for sweeping action, there is a tendency for part of the swept material to move sidewise relative to the brush and vehicle, rather than rearwardly where it might be conveniently collected. Thus, to limit the sidewise or lateral movement of swept material, it is conventional to provide a guide plate on each of the opposite sides of the brush. These plates confine the laterally moving swept particles within the brushed area and particularly prevent the rapid lateral movement of large particles or items of debris which might cause physical harm to objects alongside the sweeper.

The conventional guide plates rest upon the ground adjacent the side edges of the sweeper. Thus, to prevent rapid wear, drag shoes, like skids or skis, are secured to the lower edges of the guide plates to enable the plates to easily move upon the ground and to reduce the wear.

An attempt has been made to form the lower surface of each of the drag shoes out of a hardened material which is relatively wear resistant. Thus, relatively large, flat plates of tungsten carbide materials have been secured to the bottom surfaces of the shoes. The tungsten carbide plates resist wear caused by the abrasive action of sliding the shoes upon the ground which may be formed of concrete or the like materials.

However, although tungsten carbide plates have relatively long abrasion wear lives, they are susceptible to breakage due to the relative brittleness of tungsten carbide plates. Thus, since the plates are normally exposed to shocks or impacts due to sharp encounters with the road surface or stones or rocks or the like upon the road surface, the impact loads tend to fracture the tungsten carbide plates causing these to crumble or to otherwise crack or break sufficiently to loosen them from their fastenings to the drag shoe surfaces.

The invention herein relates to an improvement by which the tungsten carbide or similar hard carbide wear resistant materials are protected against road shock breakage.

SUMMARY OF INVENTION

The invention herein relates to applying a matrix, formed of small, irregular shaped hard carbide particles with a soft, ductile, relatively resilient brazing material filling the spaces between and substantially surrounding the particles, within a shallow, wide, channel drag shoe pad. The flat, exposed surface of the matrix engages the ground to provide a wear resistant surface beneath a typical guide plate or the like.

Road shock loads are absorbed by the matrix and the relative movement of the small particles within the matrix, while the hard carbide particles provide the necessary wear resistance and also, because of their small size and irregularity, resist fracturing due to road impacts. Thus, long wear can be expected since the otherwise deleterious effect of breakage because of the brittleness of carbide materials, is substantially eliminated.

One object of the present invention is to provide a wear resistant surface upon the bottom of a drag shoe, which surface is relatively easily produced compared with the considerable amount of hand labor and time required to form plate-type carbide wear surfaces wherein individual plates must be properly aligned and individually secured, as by welding or brazing. That is, the close packing of the carbide particles and the filling of the spaces between and surrounding the particles with the brazing material, such as a suitable ductile bronze brazing material, can be formed with less labor and time than the plate-type carbide surfaces.

Other objects and advantages of this invention will become apparent upon reading the following description, of which the attached drawings form a part.

DETAILED DESCRIPTION

Figures 1, 2, 3, 4, 5, 6, 7, 8:
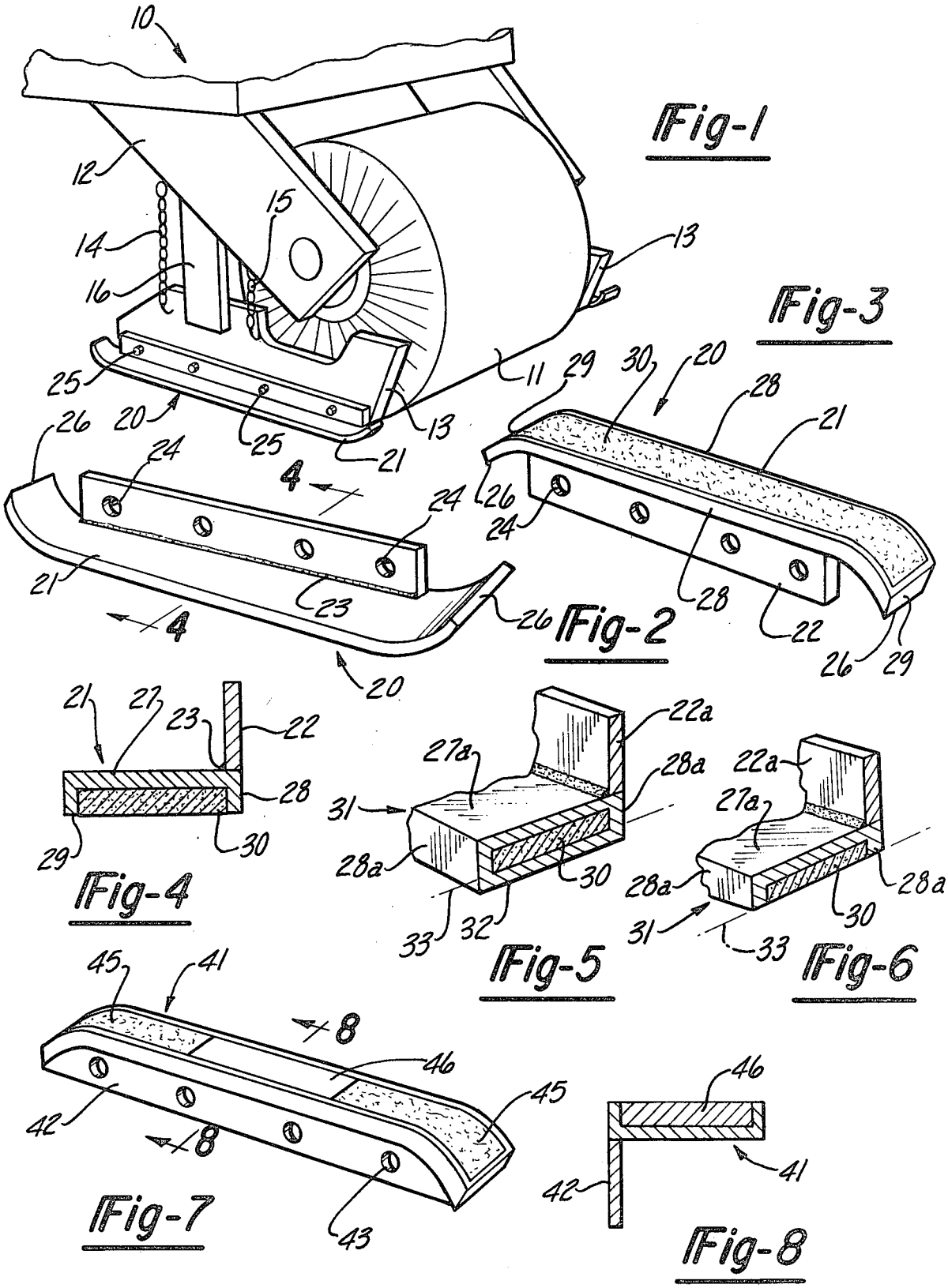
FIG. 1 is a schematic, perspective view of a portion of a typical street sweeper brush mounted upon a vehicle with side guide plates.
FIG. 2 is a perspective view of the drag shoe herein.
FIG. 3 is a perspective view of the drag shoe, but turned upside down to illustrate the lower wear resistant surface.
FIG. 4 is an enlarged, cross-sectional view taken as if in the direction of arrows 4—4 of FIG. 2.
FIG. 5 is a fragmentary, perspective, cross-sectional view of a modified drag shoe formed of a flattened tube.
FIG. 6 is a view similar to FIG. 5, but showing the lower wall of the tube removed.
FIG. 7 illustrates, in perspective view, a modified form of wear surface.
FIG. 8 is an enlarged, cross-sectional view, taken in the direction of arrows 8—8 of FIG. 7.

FIG. 1 schematically illustrates a portion of a conventional street sweeper. The sweeper is formed of a suitable self-propelled vehicle, schematically designated as 10, which carries a horizontally axised, rotary sweeper brush 11. The opposite ends of the brush are rotatably supported within frame members 12 for lowering the brush against a ground surface and for raising it. A suitable mechanism also rotates the brush.

At the opposite ends of the brush there are located vertically arranged guide plates 13 which may be supported by chain supports 14 and 15. The guide plates may be guided or restrained from lateral movement by positioning arms 16. The foregoing sweeper construction is conventional and there are many variations of the details of such construction. Thus, since the actual construction of the sweeper, the guide plates, and the brush, etc. are not relevant to the invention herein, there are described only generally and schematically. For example, the actual construction of the sweeper brush, which typically is formed of numerous bristles secured together upon an inner tube or axial, can be varied considerably, but is irrelevant to the invention herein.

The lower edges of the guide plates are typically provided with some sort of drag shoe which slides along the ground. This enables the lower edge of the plate to slide, rather than jam against or lock into the ground. Also, the shoe reduced the wear upon the lower edge of the plate so that the plate may last longer.

FIG. 2 illustrates the improved drag shoe 20 of this invention. Here, the drag shoe is formed of an elongated bar 21, which preferably is formed of a steel channel that is shallow and substantially flat. A vertically arranged attachment flange 22 is welded, at 23, along one edge of the base of the inverted channel.

Bolt holes 24 through the flange receive bolts 25 (see FIG. 1) for fastening the flange, and thus, the bar, to the lower edge of the guide plate 13.

The opposite ends of the bar are turned up to form ski-like tips 26. Thus, the drag shoe can be reversed, that is, used in either direction on either side of the guide plates. By reversing the drag shoes periodically, such as after a numer of months of use, the life of each drag shoe can be prolonged because of more even wear.

The bar 21 is formed of thin wall, stiff steel material bent into the channel shape. The channel has a base 27 and short side legs 28, with end flanges or walls 29 on the opposite ends, as illustrated in FIG. 3. The steel may be of a one-eighth inch thickness. The resulting channel is long, relatively wide, shallow and of substantially uniform depth.

The channel cavity is filled with a matrix 30. This matrix is formed of closely packed together, irregular shaped and sized hard carbide particles. For example, hard tungsten carbide particles in a range of between about 4 to 40 mesh may be utilized. The spaces between the particles are filled with a soft, ductile, relatively resilient brazing material such as a bronze type metal. The brazing metal substantially surrounds each of the particles and brazes them together into the solid matrix mass.

The irregular size and shape hard particles may be formed of available scrap tungsten carbide or other hard commercially available carbides. Because of the irregularity of size and shape, these particles tend to resist fracturing or breakage due to sharp impacts even though the material is relatively brittle. Moreover, the brazing material tends to absorb impact or shock loads by yielding under such loads and thus permitting some relative movement of the particles within the matrix. Second, the inherent resiliency of the matrix material coupled with its being substantially arranged between adjacent particles, permits it to act as a cushion, which also holds each of the particles against disengagement from the matrix.

The channel shaped bar may be produced by starting with a flat, tube rather than an open channel. Thus, FIGS. 5 and 6 illustrate a modification wherein the bar 31 is formed of a flattened steel tube having an upper base 27*a*, short side or edge legs 28*a* and a bottom or lower cover plate 32. The same matrix 30, as described above, fills the interior of the tube. Likewise, a similar attachment flange 22*a* may be used for fastening the bar upon the plate 13.

In operation, the lower wall 32 engages the ground and in a relatively short period of time is worn away due to the abrasion. When the wall 32 is worn down to the line 33 (see FIGS. 5 and 6) where the matrix is exposed, the device functions in the same manner as that previously described in connection with the drag shoe of FIGS. 2–4.

FIG. 7 illustrates a second modification wherein the bar 41 is substantially identical to the bar 21 of FIG. 3. The attachment flange 42 is substantially identical to the flange 22, but may be extended and its opposite ends welded to the turned up ends of the bar. The flange 42 may also be provided with suitable bolt holes 43.

The bar 41 is divided into three sections, namely a forward section, an intermediate section, and a trailing section. The forward and trailing sections of the bar are filled with a matrix 45 similar to that described above. However, the intermediate section is preferably filled with a monoithic filler 46, such as a flat strip of steel. This steel strip provides cushioning and resiliency for the middle area of the drag shoe bar, thereby absorbing road impact and protecting the matrix. In addition, the opposite ends of the steel strip form transverse walls within the channel which, cooperating with the opposite end walls or flanges provide an enclosed container within which the matrix is held and compressed.

With the central section metal strip in place, the forward and trailing sections of matrix provides the wear resistance for the drag shoe and the central section enhances the road impact protection.

Having fully described an operative embodiment of this invention, I now claim:

1. In a street sweeper type drag shoe including a horizontally elongated bar having forward and rear ends and a lower, ground engaging face surface and having means for attaching the bar upon a generally vertically arranged plate, the improvement comprising:

said bar having an inverted, channel-like shape with a relatively wide, horizontally elongated, thin channel forming base strip and having channel forming side legs joined with and extending downwardly from elongated edges of the base strip, to thus provide a long, relatively wide but thin channel cavity of substantially uniform depth with said channel cavity having a lower exposed face;

said channel cavity being filled with a matrix formed of relatively small size, hard tungsten carbide particles of irregular shapes and sizes, closely packed together, and with a soft, ductile, somewhat resilient brazing material such as bronze brazing material filling the spaces between and substantially surrounding the carbide particles and brazing the particles together and to the channel base strip and legs;

said matrix being resistant to wear caused by abrasion against the ground, and being shock absorbant to resist breakage of the brittle carbide particles and the matrix itself by means of the brazing material yieldably and resiliently absorbing impact forces and permitting limited relative movement of the hard carbide particles under shock loads.

2. A street sweeper type drag shoe as defined in claim 1, and said bar base strip and legs being integrally formed of weldable steel material, and including a steel cover arranged over the lower exposed face of the channel cavity, said cover being formed of a material which will be worn off by continual abrasion with the ground to thereby expose the matrix.

3. A street sweeper type drag shoe as defined in claim 1, and said bar being formed of a steel tube which is flattened to approximately a rectangular cross-section, and wherein a face of the tube being ground off by continued abrasion with the ground to thereby expose the matrix.

4. A street sweeper type drag shoe as defined in claim 1, and said bar being divided into three sections along its length, namely, a leading section, a trailing section and an intermediate section, with the leading and trailing sections each being filled with the matrix, but with the intermediate section being filled with a generally monolithic material, such as a strip of steel, which will normally wear faster than the matrix due to ground abrasion, but which is protected against rapid wear by the more wear resistant matrix filled leading and trailing sections.

5. A street sweeper type drag shoe as defined in claim 4 and with the forward and rear ends of the bar being bent upwardly to form ski tip-like ends on the bar, and said bar being attachable in reversible directions, that is, for reversing the forward and rear ends thereof relative to said plate.

6. A street sweeper type drag shoe as defined in claim 5, and said bar being formed of a flattened steel tube which is approximately rectangular in cross-section, with the lower face being removable by continued abrasion with the ground to thereby expose the matrix.

7. A street sweeper type drag shoe as defined in claim 4, and wherein the opposite ends of the channel-like bar being closed with downwardly depending flanges which are joined to and of the same depth as the side legs;

and wherein the opposite ends of the material filling the intermediate section forming transverse walls within the channel-like bar;

and said matrix being compacted and compressed between the channel side legs and the adjacent walls and flanges.

* * * * *